US005255437A

United States Patent [19]

Chen

[11] Patent Number: 5,255,437

[45] Date of Patent: Oct. 26, 1993

[54] CLIPPER FOR TRIMMING HAIR IN A NOSTRIL

[76] Inventor: Chi-Fu Chen, No. 3; Alley 16, Lane 242 Chung-Cheng S. Rd., Chia-Ting Tsun, Yung-Kang Hsiang, Tainan Hsien, Taiwan

[21] Appl. No.: 19,050

[22] Filed: Feb. 18, 1993

[51] Int. Cl.[5] ..... B26B 19/14

[52] U.S. Cl. ..... 30/29.5; 30/263

[58] Field of Search ..... 30/29.5, 43.6, 263, 30/265, 346.51

[56] References Cited

U.S. PATENT DOCUMENTS

| | | | |
|---|---|---|---|
| 2,312,933 | 3/1943 | Seiders | 30/29.5 |
| 2,759,259 | 8/1936 | McDermott | 30/29.5 |
| 4,571,827 | 2/1986 | Lee | 30/29.5 |

FOREIGN PATENT DOCUMENTS

| | | | |
|---|---|---|---|
| 170819 | 7/1934 | Switzerland | 30/29.5 |

*Primary Examiner*—Doulgas D. Watts
*Attorney, Agent, or Firm*—Ladas & Parry

[57] ABSTRACT

A clipper includes a first hollow tube that has an upper end provided with a first detachable trimming device and a lower end that is provided with a circumferential oblong slot that has an axial access which extends from the periphery of the lower end. The axial access includes two opposed faces, one of which has a projection formed thereon. The projection and a remaining one of the faces cooperatively define a predetermined clearance. A second hollow tube is inserted co-axially into the first tube and has an upper end provided with a second detachable trimming device, and a lower end that has an engaging rod which extends radially outward from an external surface of the second tube. The engaging rod has a diameter that is wider than the predetermined clearance. The engaging rod is pressed past the projection of the axial access of the first tube when the second tube is inserted into the first tube. Each of a pair of pressing plates has an upper portion attached pivotally to the upper end of the first tube and a lower end which is provided with a notch that engages the engaging rod of the second tube. A biasing spring biases lower portions of the pressing plates to move away from each other.

3 Claims, 9 Drawing Sheets

CLIPPER FOR TRIMMING HAIR IN A NOSTRIL

BACKGROUND OF THE INVENTION

1. Field of the Invention

The invention relates to a clipper, more particularly to a clipper for trimming hair in a nostril.

2. Description of the Related Art

FIG. 1 shows a conventional clipper for trimming hair in a nostril. As best illustrated, the conventional clipper includes first and second hollow metal tubes (11, 12). The first hollow metal tube (11) has an upper end which is provided with a first trimming device (112), a lower end which is formed with an elongated peripheral notch (113), and a through hole (114) which is formed through a wall body of the first tube (11). The second hollow metal tube (12) is inserted co-axially into the first tube (11) and has an upper end which is provided with a second trimming device (121), a lower end which is formed with two diametrically opposed rods (122) that extend radially outward from an external surface of the second tube (12) and that extend at right angles relative to the elongated peripheral notches (113), and an annular groove (123) which is communicated with the through hole (114). A locking screw (16) passes threadedly through the through hole (114) of the first tube (11) and extends into the annular groove (123) of the second tube (12), thereby engaging the first and second tubes (11, 12). Each of a pair of elongated pressing plates (14) has an upper portion (142) that is attached threadedly and pivotally to the upper end of the first tube (11), and a lower portion that is provided with an engaging notch (141). The rods (122) of the second tubes (12) pass through the notch (141) of the respective elongated pressing plate (14). A biasing unit (15) biases the lower portions of the elongated pressing plates (14) away from each other.

Referring to FIG. 2, when the lower portions of the elongated pressing plates (14) are pressed towards each other against action of the biasing unit (15), the second tube (12) rotates relative to the first tube (11) in a first direction, as shown in FIG. 4, wherein the first and second trimming devices of the first and second tubes (11, 12) cooperatively perform a trimming operation. When the pressing force is removed, the biasing unit (15) expands to rotate the second tube (12) relative to the first tube (11) in a second direction opposite to the first direction, as shown in FIG. 3.

Some drawbacks of the conventional clipper are as follows:

(1) In order to engage the first and second tubes (11, 12), a through hole (114) and an annular groove (123) must be formed in the first and second tubes (11, 12). This requires additional processing and can increase the manufacturing cost.

(2) In order to remove hair that is left behind after the trimming operation, the first and second tubes (12) must be disassembled, thereby inconveniencing the user.

(3) Since the upper portion of the elongated pressing plate (14) is pivoted threadedly to the upper end of the first tube (11), the threaded screw (13) may loosen after a period of use, thereby rendering the clipper useless.

(4) The trimming devices at the upper ends of the first and second tubes (11, 12) are integrally formed and provide a unique trimming operation. In order to obtain different trimming effects, one must buy several clippers with differing trimmer sizes, thus resulting in extra expenditures for the consumer.

SUMMARY OF THE INVENTION

A main objective of the present invention is to provide a clipper that includes first and second hollow plastic tubes which are easy to assemble and which minimizes the possibility of untimely disengagement between the first and second tubes.

A second objective of the present invention is to provide a clipper that includes trimming devices which are detachable from the first and second tubes and which are replaceable so as to facilitate cleaning of the clipper.

A third objective is to provide a clipper that includes a pair of elongated pressing plates which cannot be easily removed from the first tube even after a long period of use.

According to the present invention, the clipper includes a first hollow tube and a second hollow tube which is inserted co-axially into the first tube, and a pair of pressing plates. The upper end of the first tube is provided with a first detachable trimming device, two diametrically opposed pivot rods which extend radially outward from a wall body of the first tube adjacent to the upper end, a pair of opposed oblong circumferential slots formed adjacent to a lower end of the first tube, and a pair of opposed axial accesses. Each of the axial accesses extends from the periphery of the lower end of the first tube and is communicated with the circumferential slot. Each of the axial accesses has two opposed faces. One of the opposed faces has a projection that cooperates with a remaining one of the opposed faces to form a predetermined clearance therebetween. The second tube has an upper end provided with a second detachable trimming device and a lower end provided with a pair of diametrically opposed engaging rods. Each of the engaging rods has a diameter that is wider than the predetermined clearance. Each of the elongated pressing plates has an upper portion provided with a pair of engaging holes. Each of the pivot rods of the first tube passes through one of the engaging holes, thereby engaging pivotally the upper portion of the elongated pressing plates and the first tube. Each of the pressing plate further has a lower portion which is provided with a notch that extends from a bottom periphery of the lower portion. The engaging rods of the second tube move past the predetermined clearance of the axial accesses and extend through the circumferential slots of the first tube when the second tube is inserted into the first tube. The engaging rods of the second tube further extend outward through the notches of the pressing plates. A biasing unit biases lower portions of the pressing plates away from each other. When the pressing plates are pressed toward each other against action of the biasing unit, the engaging rods of the second tube are pushed by the pressing plates so as to rotate the second tube in a first direction relative to the first tube, thereby permitting the first and second trimming devices to trim cooperatively the hair. When the pressing force on the pressing plate is removed, the biasing unit expands to push the pressing plates away from each other, thereby pushing the engaging rods so as to rotate the second tube in a second direction opposite to the first direction relative to the first tube.

BRIEF DESCRIPTION OF THE DRAWINGS

Other features and advantages of the present invention will become more apparent in the following detailed description of the preferred embodiments with reference to the accompanying drawings, in which.

DETAILED DESCRIPTION OF THE PREFERRED EMBODIMENTS

Figure 1:
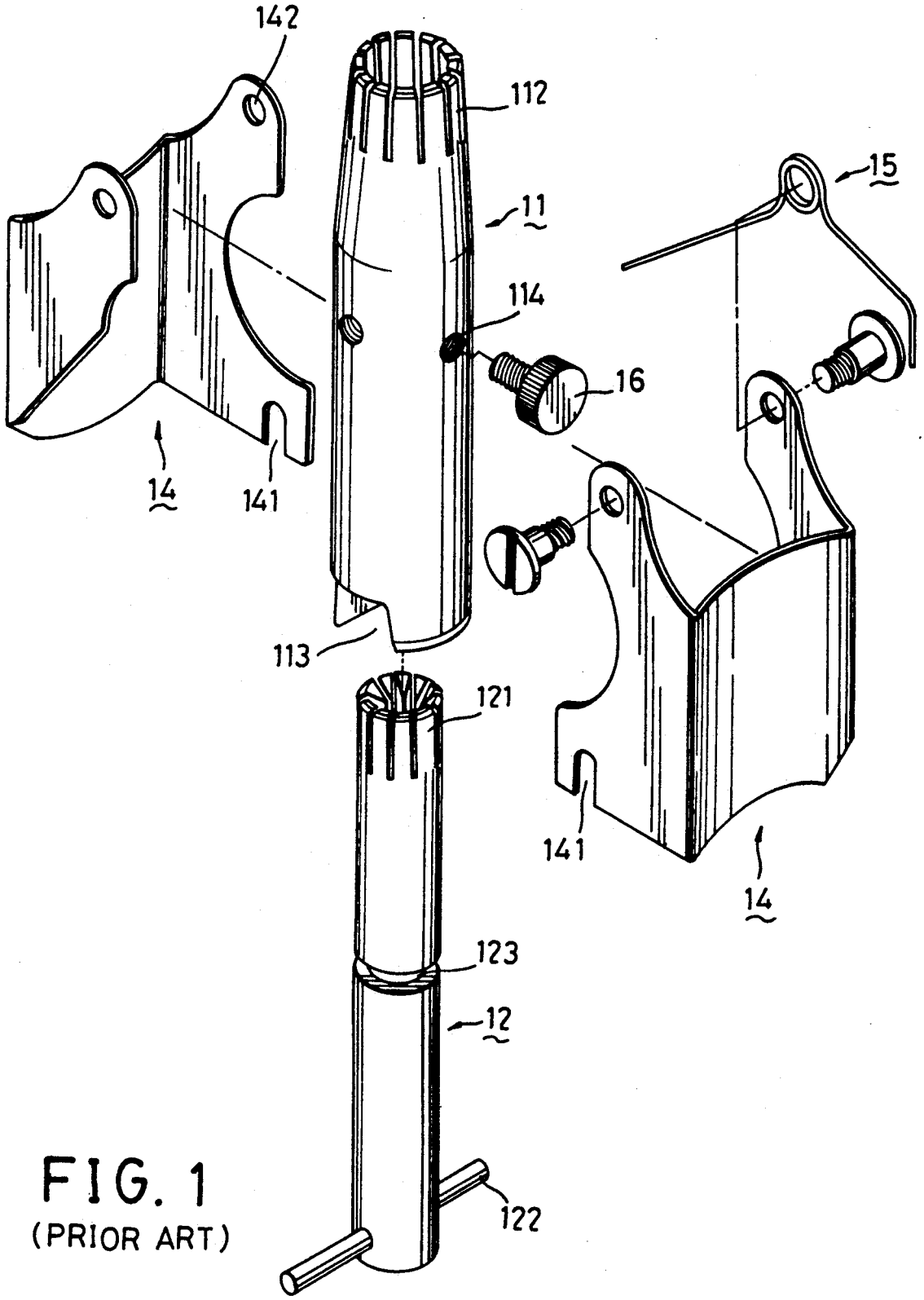
FIG. 1 (PRIOR ART)
FIG. 1 is an exploded view of a conventional clipper for trimming hair in a nostril.
Figure 2:
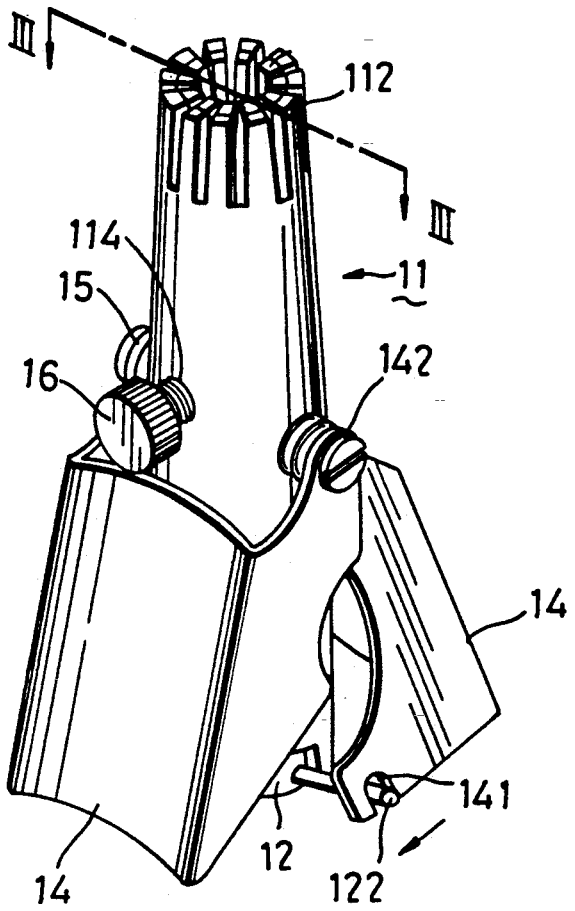
FIG. 2 (PRIOR ART)
FIG. 2 is an assembled view of the conventional clipper.
Figure 3:
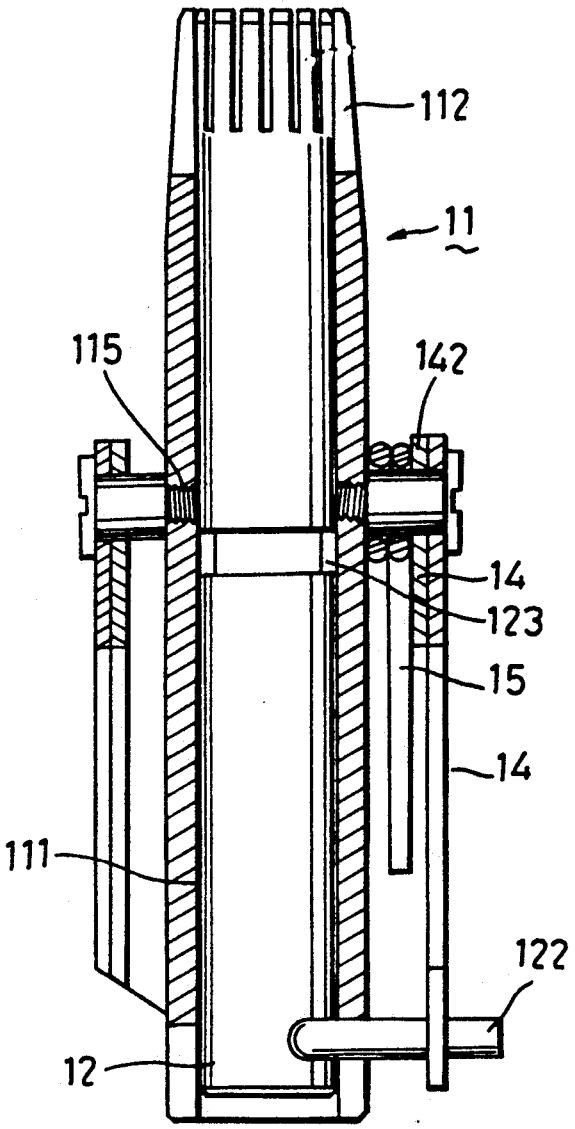
FIG. 3 (PRIOR ART)
FIG. 3 is a cross sectional view of the conventional clipper of FIG. 2 taken along the line III—III.
Figure 4:
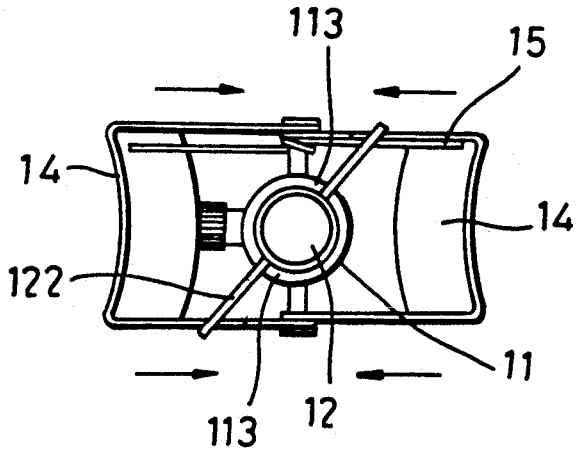
FIG. 4 (PRIOR ART)
FIG. 4 is a bottom view of the conventional clipper shown in FIG. 2.
Figure 5:
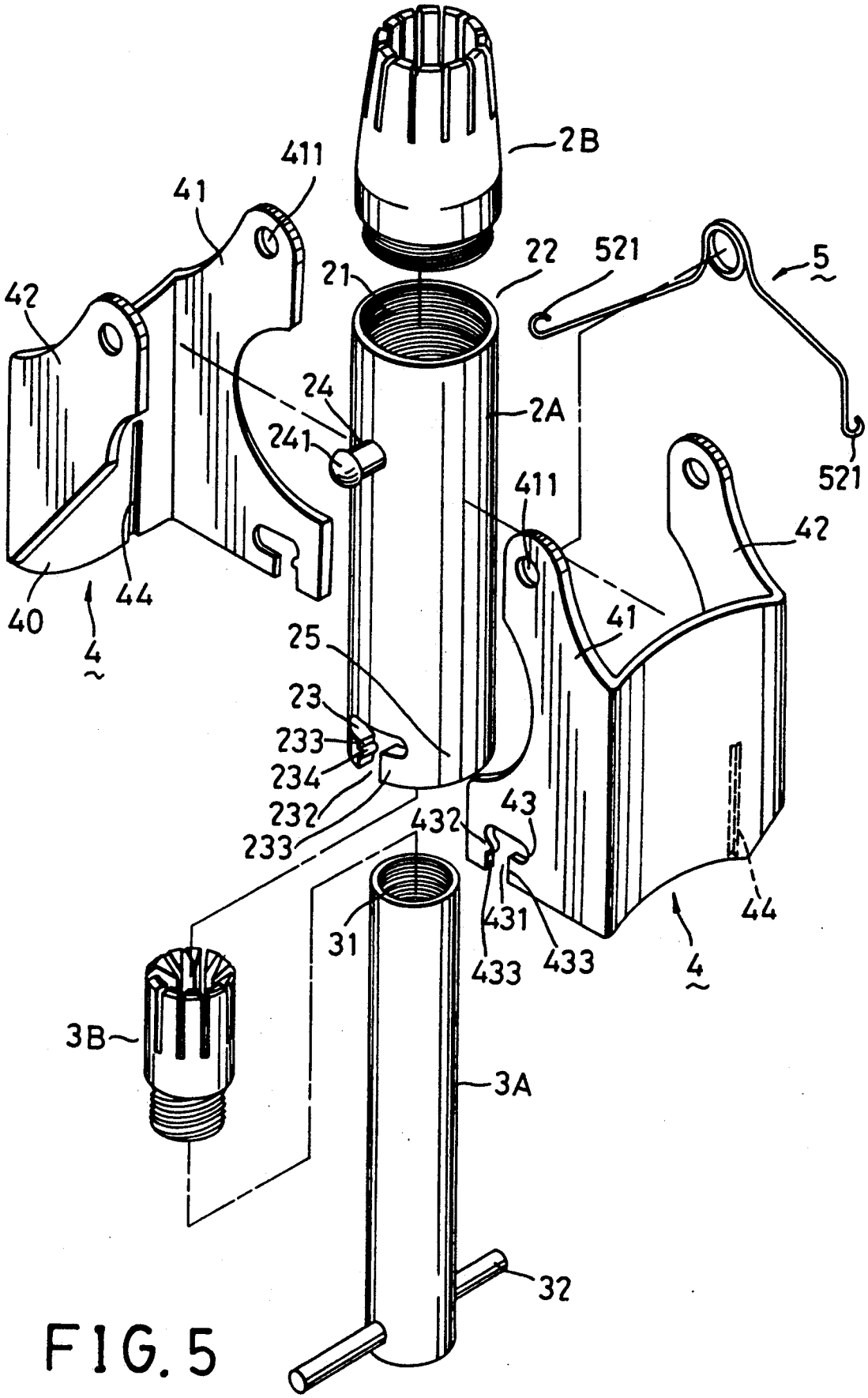
FIG. 5 is an exploded view of a clipper of the present invention.

Referring to FIG. 5, an exploded view of a clipper of the present invention is shown to comprise a first and second hollow plastic tubes (2A, 3A), a pair of plastic pressing plates (4) and a biasing spring (5).

The first hollow tube (2A) has an upper end (22) with an internally threaded section (21) which receives threadedly a first trimming device (2B) and a pair of diametrically opposed pivot rods (24) with enlarged heads (241) that extend radially outward from an external wall surface of the first tube (2A), and a lower end (25) that has a pair of opposed oblong circumferential slots (23). The first tube (2A) further has two opposed axial accesses (232) that extend from the periphery of the lower end (25) and that are communicated with a respective one of the oblong circumferential slots (23). Each of the axial accesses (232) includes two opposed faces (233), one of which has a projection (234) formed thereat. The projection (234) and a remaining one of the two opposed faces (233) cooperatively define a predetermined clearance therebetween.

Figure 7:
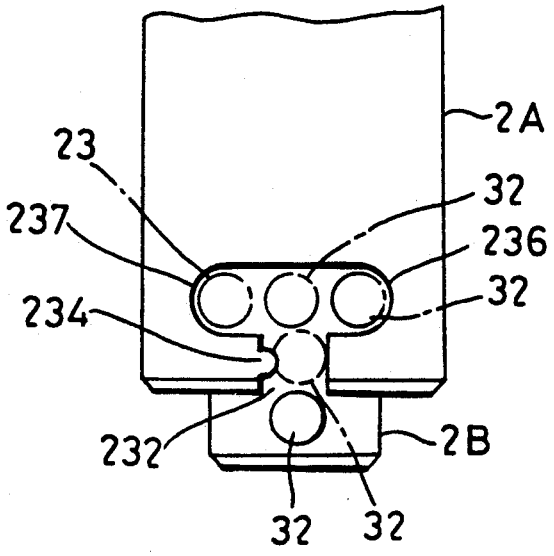
FIG. 7 shows how a second tube is fitted into a first tube of the clipper of the present invention.
Figure 8:
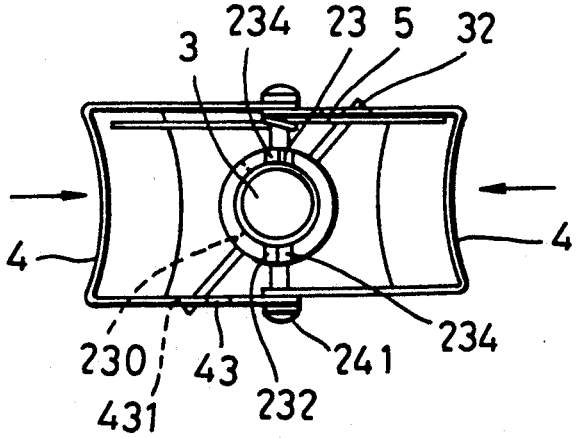
FIG. 8 shows a bottom view of the clipper of the present invention.

The second hollow tube (3A) has an upper end with an internally threaded section (31) which receives threadedly a second trimming device (3B) and a lower end which has a pair of diametrically opposed engaging rods (32) that extends radially outward from an external surface of the second tube (3A). The engaging rods (32) of the second tube (3A) have a diameter that is wider than the predetermined clearance of the axial access (232). During assembly, the second tube (3A) is inserted co-axially into the first tube (2A) such that the engaging rods (32) move past the projection (234) of the axial access (232), as shown in FIG. 7. Thus, the engaging rods (32) of the second tube (3A) can extend into the circumferential slots (23) of the first tube (2A), as shown in FIG. 8.

Each of the pressing plates (4) has a press portion (40) with two parallel sides. First and second flanges (41, 42) extend respectively and perpendicularly from the parallel sides. Each of the first and second flanges (41, 42) has an upper portions which is provided with an engaging holes (411). The enlarged heads (241) of the pivot rods (24) are pressed past the engaging holes (411) of the first and second flanges (41, 42), thereby engaging pivotally the upper portion of the elongated pressing plate (4) to the first tube (2A). A lower portion of the first flange (41) has an oblong slot (43) located transverse to a longitudinal length of the flange (41) and a notch (431). The notch (431) includes two opposed faces (433), one of which has a protrusion (432). The protrusion (432) and a remaining one of the two opposed faces (433) cooperatively defines a second clearance therebetween. The second clearance is narrow than the diameter of the engaging rods (32) of the second tube (3A). The engaging rods (32) of the second tube (3A) are pressed past the protrusions (432) in the notches (431) during assembly so that the engaging rod (32) extends outward through the oblong slot (43) of the pressing plates (4).

The biasing spring (5) has an intermediate portion which is sleeved one of the pivot rods (24) of the first tube (2A). Two ends (521) of the biasing spring (5) extend into two elongated grooves (44) which are formed respectively on internal surfaces of the press portion (40) of the pressing plates (4). The biasing spring (5) moves the lower portions of the pressing plate (4) away from each other at a normal condition.

The engaging rod (32) of the second tube (3A) are movable in the circumferential slots (23) of the first tube (2A) when the second tube (3A) rotates relative to the first tube (2A). The engaging rods (32) are movable between a first position, wherein the engaging rods (32) of the second tube (3A) move to a first end (237) of the circumferential slots (23), as shown in FIG. 7, and a second position, wherein the engaging rods (32) of the second tube (3A) move to a second end (236) of the circumferential slots (23) which is opposite to the first end (237).

When the pressing plates (4) are pressed towards one another against action of the biasing spring (5), the second hollow tube (3A) rotates relative to the first hollow tube (2A) in a first direction, thereby placing the engaging rod (32) of the second tube (3A) at the first position, thereby permitting the first and second trimming devices (2B, 3B) of the first and second hollow tubes (2A, 3A) to trim cooperatively hair which is located between the two trimming devices (2B, 3B). Since the trimming operation is known in the art, a detailed description of such operation is omitted herein. Removal of the pressing force from the pressing plates (4) permits the second tube (3A) to rotate relative to the first tube (2A) to a second direction opposite to the first direction, thereby placing the engaging rods (32) of the second tube (3A) at the second position, thereby permitting the first and second trimming devices (2B, 3B) of the first and second tubes (2A, 3A) to effect another trimming operation provided that each of the trimming devices has opposite cutting edges.

Figure 9:
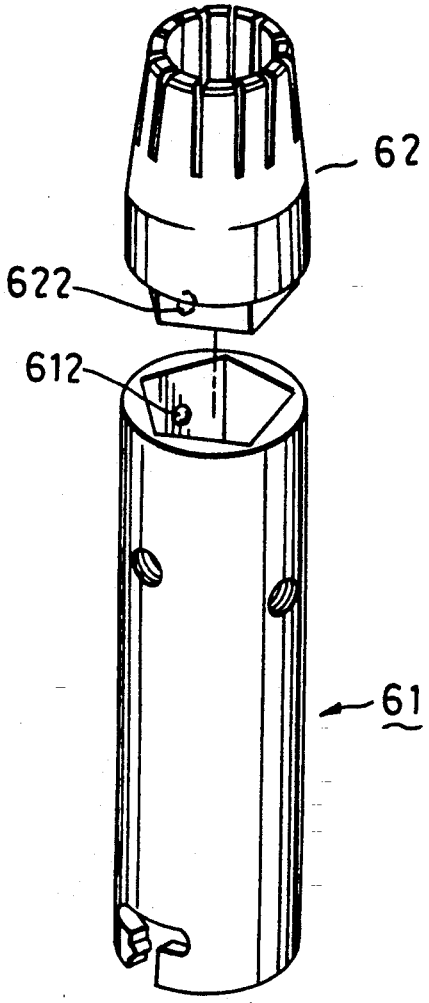
FIG. 9 shows an engaging method used in the clipper of the present invention.

Referring to FIG. 9, in one preferred embodiment of the present invention, a trimming device (62) can be attached to the upper end of the first or second hollow tube (61) by using a stud and socket (622, 612) engaging method.

Figure 10:
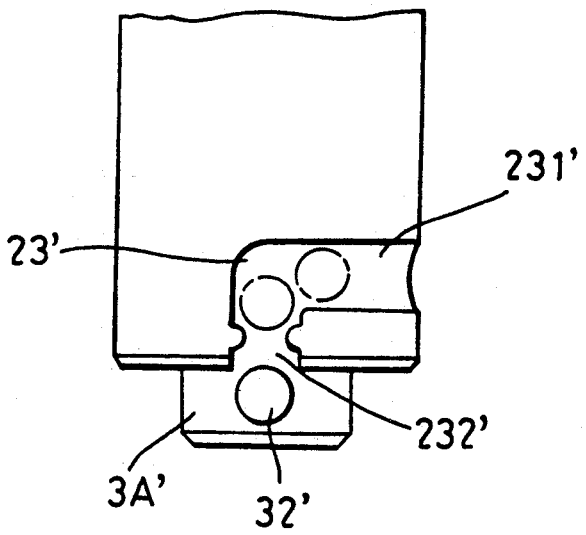
FIG. 10 shows a partial view of another preferred embodiment of the clipper of the present invention.

Referring to FIG. 10, in another preferred embodiment of the present invention, the axial access (232') of the second tube can be provided with two projections (234') which cooperatively define a second predetermined clearance therebetween. The second predetermined clearance, however, should be maintained narrower than the diameter of the engaging rod (32') of the second tube (3A'). The features and objectives of this embodiment are the same as that of the first embodiment.

Figure 6:
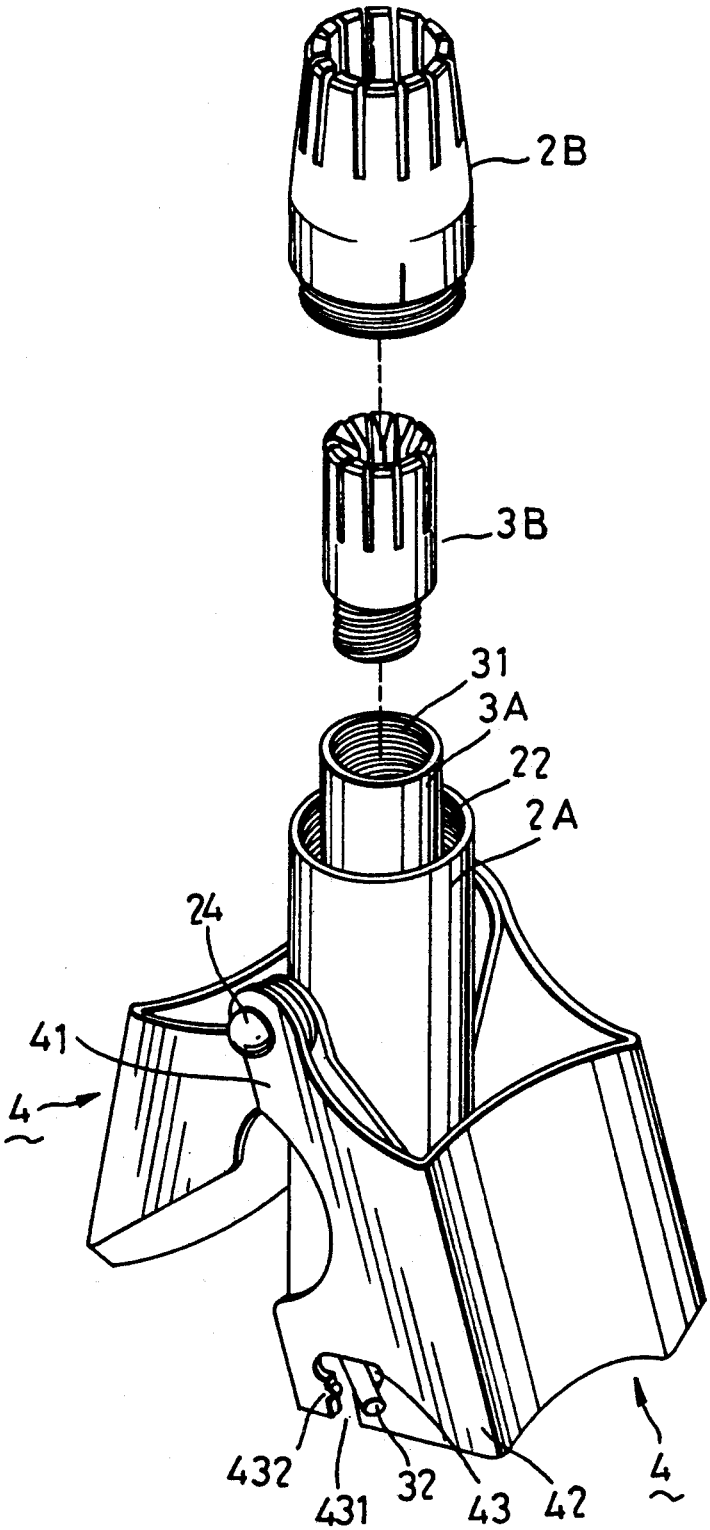
FIG. 6 is an assembled view of the clipper of the present invention with the trimming devices of the clipper being removed.

As illustrated above, since the first and second trimming devices of the clipper of the present invention are detachable from the first and second tubes (2A, 3A), cleaning of hair that is left behind after the trimming operation is facilitated. The clipper of the present invention can also be fitted with trimming device of different sizes, as shown in FIG. 6.

An important aspect to note is that since the first and second tubes (2A, 3A) and the elongated pressing plates (4) are made of plastic, the second tube (3A) and the pressing plates (4) are press-fitted to the first tube (2A) during the assembly of the clipper of the present invention. No locking screw, through hole are required in the first tube and no an annular recess is to be formed on an external surface of the second tube, thus facilitating assembly of the clipper and preventing the untimely disengagement of the second tube (3A) from the first tube (2A) after a long period of use.

While a preferred embodiment have been described and illustrated, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. A clipper for trimming hair in a nostril, comprising:

a first hollow cylindrical tube including a wall body that has an upper end provided with a first trimming device, a lower end, two diametrically opposed pivot rods extending radially outward from said wall body adjacent to said upper end, a pair of opposed oblong circumferential slots formed adjacent to said lower end, and a pair of opposed axial accesses, each of said axial accesses extending from the periphery of said lower end and being communicated with a respective one of said oblong circumferential slots, each of said axial accesses having two opposed faces, one of said opposed faces being provided with a projection which cooperates with a remaining one of said opposed faces to form a predetermined clearance therebetween;

a second hollow cylindrical tube having an upper end provided with a second trimming device and a lower end formed with a pair of diametrically opposed engaging rods that extends radially outward from said second hollow tube, said engaging rods having a diameter that is wider than said predetermined clearance;

a pair of pressing plates, each including a press portion with two parallel sides and first and second elongated flanges which extend perpendicularly and respectively from said parallel sides, each of said first and second elongated flanges having an upper portion provided with an engaging hole and a lower portion, said pivot rods of said first tube extending through said engaging holes of said first and second flanges to mount pivotally said pressing plates on said first tube, said lower portion of said first flange being formed with a notch, said second tube being inserted co-axially into said first tube such that said engaging rods of said second tube move past said clearance in said axial accesses to extend into said circumferential slots, said engaging rods of said second tube further extending outward through said notch of a respective one of said pressing plates; and biasing means for biasing said pressing plates away from each other;

whereby, when said pressing plates are pressed toward each other against action of said biasing means, said engaging rods of said second tube are pushed by said pressing plates so as to rotate said second tube in a first direction relative to said first tube, thereby permitting said first and second tubes to trim cooperatively said hair, when said pressing force on from said pressing plates is removed, said biasing means expands to push said pressing plates away from each other, thereby pushing said engaging rods so as to rotate said second tube in a second direction opposite to said first direction relative to said first tube.

2. The clipper as defined in claim 1, wherein said first and second trimming devices of said first and second tubes are detachable from said upper ends of said first and second tubes.

3. The clipper as defined in claim 1, wherein said first and second tubes and said pressing plates are made of plastic.

* * * * *